US006869029B2

(12) United States Patent
Ochoa, Sr. et al.

(10) Patent No.: US 6,869,029 B2
(45) Date of Patent: Mar. 22, 2005

(54) WATER SPRAY SYSTEM FOR A DISHWASHER

(75) Inventors: Orlando P. Ochoa, Sr., Walnut, CA (US); Joey J. Kitabayashi, San Dimas, CA (US)

(73) Assignee: Distinctive Appliances, Inc., City of Industries, CA (US)

( * ) Notice: Subject to any disclaimer, the term of this patent is extended or adjusted under 35 U.S.C. 154(b) by 284 days.

(21) Appl. No.: 10/114,877

(22) Filed: Apr. 2, 2002

(65) Prior Publication Data

US 2003/0192578 A1 Oct. 16, 2003

(51) Int. Cl.[7] ..... B05B 1/34

(52) U.S. Cl. ..... 239/380; 134/56 D; 134/57 D; 134/58 D; 134/176

(58) Field of Search ..... 239/380, 381; 134/56 D, 57 D, 58 D, 144, 172, 174, 176, 179, 180, 183, 201

(56) References Cited

U.S. PATENT DOCUMENTS

| | | | | | |
|---|---|---|---|---|---|
| 2,320,133 | A | | 5/1943 | Horwitz | 141/9 |
| 2,407,533 | A | | 9/1946 | Brock | 134/199 |
| 2,664,902 | A | | 1/1954 | Campion | 134/175 |
| 2,808,842 | A | | 10/1957 | Pollock et al. | 134/101 |
| 2,904,265 | A | | 9/1959 | Lyman | 239/553 |
| 2,977,963 | A | | 4/1961 | Klint | 134/179 |
| 3,104,669 | A | | 9/1963 | Claywell | 134/57 |
| 3,285,779 | A | | 11/1966 | Dunham | 134/44 |
| 3,446,219 | A | | 5/1969 | Hilleman | 134/100 |
| 3,809,106 | A | * | 5/1974 | Crabtree | 134/176 |
| 3,926,668 | A | * | 12/1975 | Ross | 134/179 |
| 5,823,211 | A | | 10/1998 | Wilhelmstatter et al. | 134/176 |
| 5,904,166 | A | | 5/1999 | Nannt et al. | 134/179 |
| 6,053,185 | A | * | 4/2000 | Beevers | 134/56 D |
| 6,431,188 | B1 | * | 8/2002 | Laszczewski et al. | 134/56 D |

* cited by examiner

*Primary Examiner*—David A. Scherbel
*Assistant Examiner*—Thach H. Bui
(74) *Attorney, Agent, or Firm*—Fulbright & Jaworski; Conrad R. Solum, Jr.

(57) ABSTRACT

A water spray system for dishwasher with an upper dish rack and a lower dish rack, with each said dish rack being mounted for selective movement forwardly out the open front. A spray tube is rotatably mounted on the bottom of each lateral side portion of each said dish rack and has a plurality of spray outlets spaced along the tube and directed generally tangentially in the same direction for causing rotation of the tube. A water supply manifold extends up the rear wall of the dishwasher. A releasable water connection device and conduits mounted on each dish rack connect the manifold to the spray tubes for supplying the water from a pump. Spray spinners are centrally mounted below each dish rack. The spray tubes provide a thorough spray at the lateral sides that the spinners may not reach in a very wide dishwasher. Other rotating spray tube arrangements are also disclosed.

36 Claims, 12 Drawing Sheets

WATER SPRAY SYSTEM FOR A DISHWASHER

The present invention relates to a domestic dishwasher and, in particular, to a dishwasher water spray system for more thoroughly washing and rinsing items in the lateral sides and corners of the dishwasher; such as one that is substantially wider than the front-to-back depth.

In recent years the design of premiere kitchen appliances for homes have tended toward increasing the width of each appliance to increase the capacity and size of the appliance, as well as creating a "commercial" appliance appearance because of the increased size. For example, premiere built-in ovens now are often thirty inches wide and or more it is desirable from an aesthetic standpoint to provide the other built-in kitchen appliances of the same width. Of course, the increased width beneficially increases the capacity of each appliance. On the other hand, kitchen cabinets have remained approximately the same depth of about twenty-four inches or less. This results in the modern premiere appliances being significantly wider than their depths. However, conventional dishwashers rely on centrally located spinners that rotate on a vertical axis for spraying water throughout the interior of the dishwasher but the diameter of the spinner is limited by the front-to-back depth of the dishwasher cabinet. As a result, the lateral sides and corners of a modern premiere dishwasher of increased width do not receive the same amount of water spray from the spinners as the center portion. For example, a typical dishwasher spinner is limited to approximately eighteen inches (18") in diameter and yet the interior width of a modern premiere dishwasher may be over twenty eight inches (28"), whereby the spinner does not extend below about five inches (5") on each lateral side of the dishwasher and, of course, the four corners of the dishwasher interior cabinet are even further from the spinner.

It is a principle object of the present invention to provide a novel dishwasher rack and water spray system wherein the lateral extremities and vertical corners of the interior of the dishwasher are adequately sprayed with wash and rinse water. A further object of this invention is to provide such a dishwasher in which tubes with spray outlets are mounted on the lateral sides of the dishwasher interior and each tube is mounted to rotate about its axis for spraying water in the lateral extremities and corners of the dishwasher. A still further object of this invention is to provide such a dishwasher in which such rotating tubes are mounted horizontally on lateral portions of the dish rack to spray water from the lateral sides of the dish rack. A still further object of this invention is to provide alternate forms of such a dishwasher spray system in which the rotating spray tubes are mounted on the lateral sides of the dishwasher interior separate from the dish racks. A more detailed object of this invention is to provide such a dishwasher which the rotating spray tubes are mounted horizontally, vertically or at an appropriate angle for accomplishing the most effective dishwashing and rinsing.

Other and more detailed objects and advantages of the present invention will appear to those skilled in the art from the following description of the preferred embodiments and the accompanying drawings, wherein.

Figure 1:
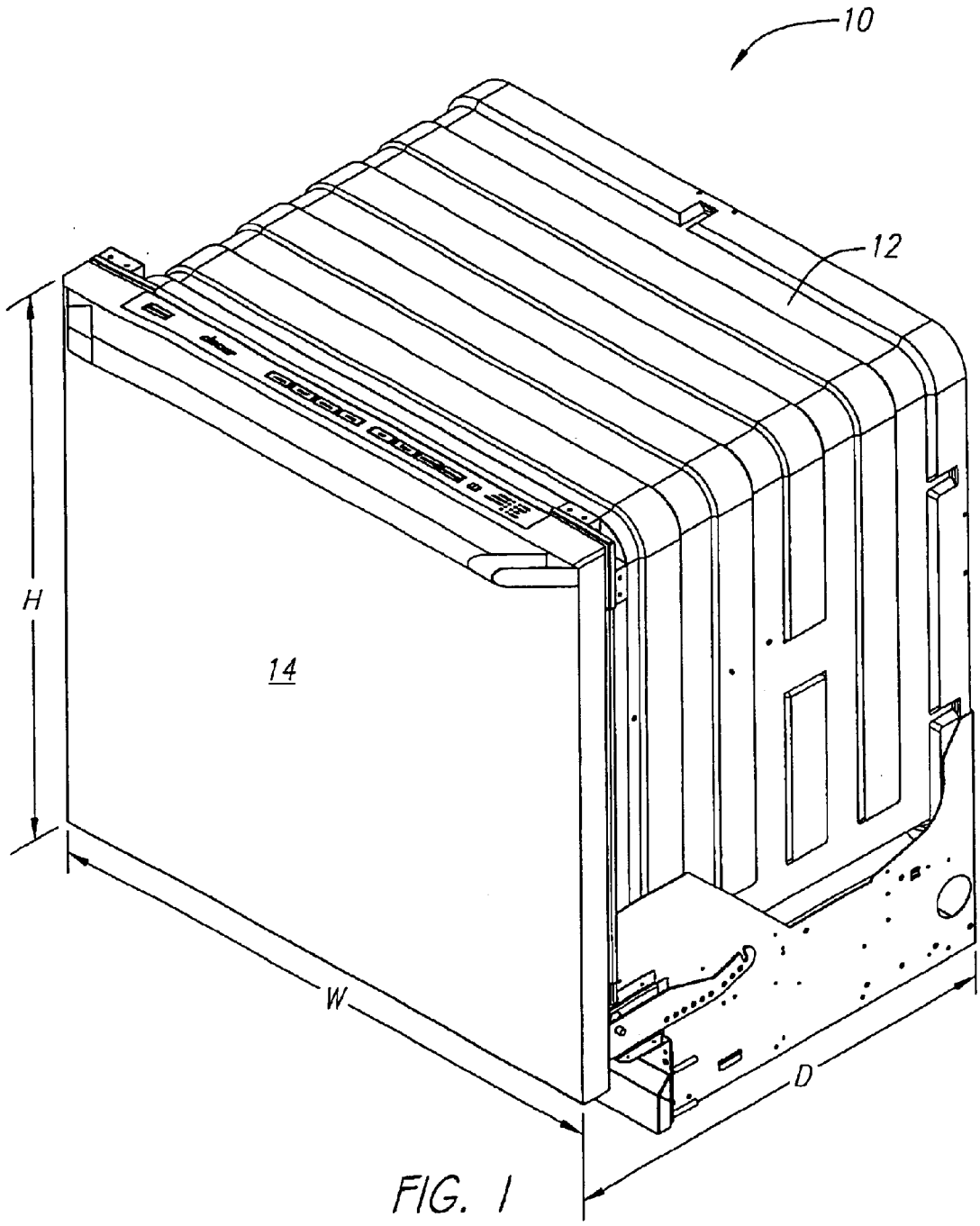
FIG. 1 is a perspective view of a dishwasher of the type incorporating the present invention, although the inventive features are not visible.

Referring now to FIG. 1, a domestic kitchen dishwasher 10 is illustrated that is of the type for being built into a cabinet whereby it has an exterior housing 12 without a decorative appearance and a front door 14 with a decorative appearance. The dishwasher 10 has a height H, width W and a depth D suitable for mounting in a typical domestic kitchen cabinet under the kitchen counter. As noted above, normally the depth of a typical kitchen cabinet is limited whereby the depth D of the dishwasher is limited to approximately 24 inches and yet modern premium built-in kitchen appliances typically are much wider than 24 inches, such as 30 or even 36 inches wide. As will become more apparent from the following description of the other Figures, the present invention is particularly applicable to a dishwasher having a width W substantially larger than the depth D although the invention also is applicable to dishwashers of any width or depth.

Referring more particularly to FIGS. 2–5, an upper dish rack, generally designated 16, is comprised of a wire basket constructed in a conventional manner with a plurality of crisscrossing and encircling wire segments 18 connected to each other to provide a space for supporting cups, glasses, small dishware, long utensils and the like in the usual manner. The upper rack 16 is provided with any conventional support means for allowing the rack to be rolled out the front of the dishwasher 10 when the door 14 is opened, such as a pair of upper rollers 20 and a pair of lower rollers 22 on each side of the rack 16 that engage a track (not shown) mounted on each side wall of the dishwasher 10.

Figure 6:
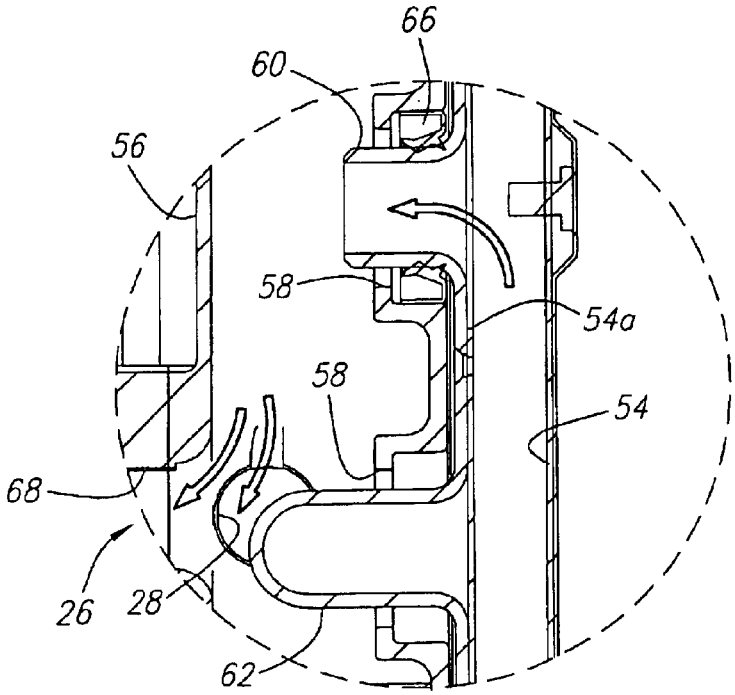
FIG. 6 is an enlarged view of the water supply connection arrangement for the upper dish rack taken at the circle 6 shown in FIG. 2.
Figure 11:
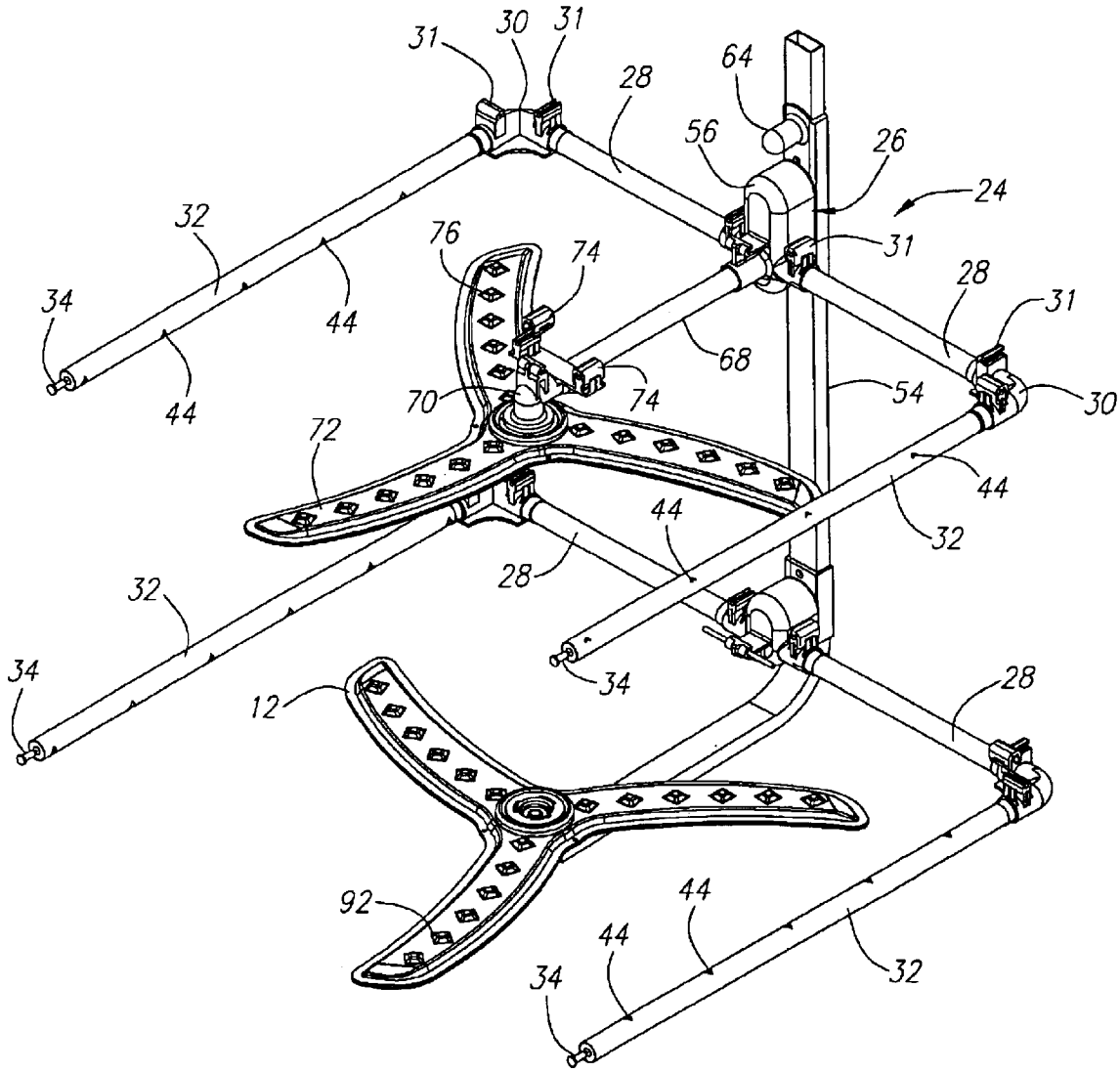
FIG. 11 is a perspective view of the water circulation and spray components of the dishwasher of the present invention shown in the preceding Figures but with the upper and lower dish racks omitted for clarity of illustration.
Figure 12:
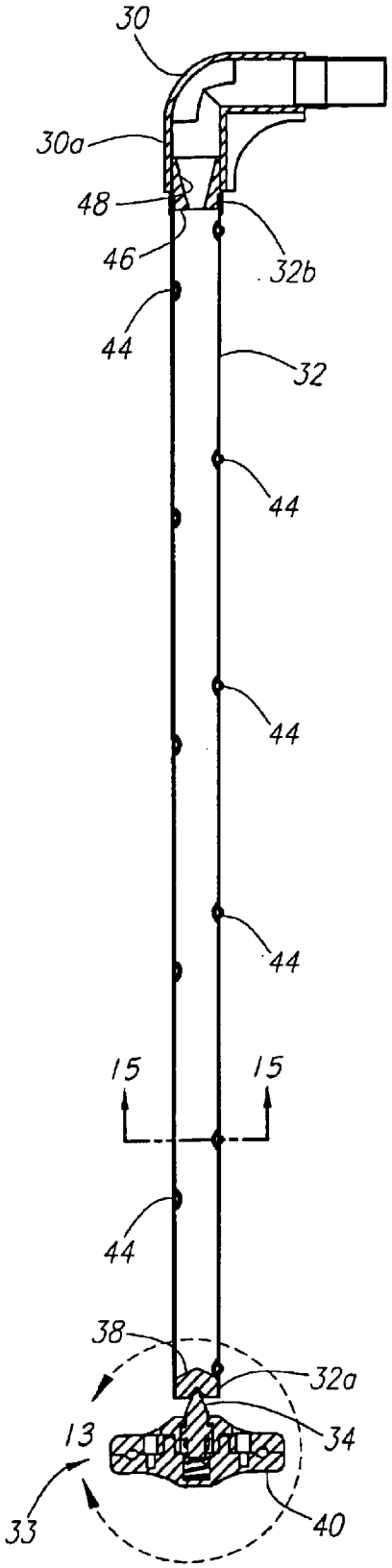
FIG. 12 is a sectional plan view of one of the left side water spray tubes shown in FIG. 11.

Referring also to FIGS. 6 and 11, the upper rack 16 is provided with a water spraying system, generally designated 24, that is mounted on the underside of the rack 16 and moves into and out of the front of the dishwasher 10 with the rack 16. A releasable water connection arrangement 26 is provided at the rear of the rack 16 for supplying water to the spraying system 24, as described more fully below with respect to FIG. 6. Water conduits 28 extend laterally in opposite directions from the connection arrangement 26 along the rear portion of the rack 16 to an elbow 30 at each lateral side of the rack. The connection arrangement 26, conduits 28 and elbows 30 are support from the rack by any convenient means, such as clips 31 connected to the wires 18. A water spray tube 32 is rotatably mounted in the forward extending portion 30*a* of each elbow 30 (see FIG. 12). The forward end 32*a* of spray tube 32 is rotatably supported by any convenient support mechanism 33, such as a pointed pin 34 engaging a conical depression 36 in a plug 38 fixedly mounted in the front end 32*a* of the spray tube 32 (also see FIG. 13). Preferably the pin 34 is cylindrical and has a cylindrical flange 34*a* slidably mounted in a cylindrical cavity 40*a* of a bracket 40 mounted on the bottom front portion of the upper rack 16, such as by clamping the bracket 40 onto a pair of spaced wires 18 of the rack. A coil spring 42 is mounted in the bracket 40 to engage the rear surface of the flange 34*a* to thereby resiliently urge the pointed end of the pin 34 into the conical depression 36 of the plug 38 on the spray tube 32. By this arrangement the spray tube 32 is rotatably mounted on the underside of the rack 16 in a very simple and inexpensive manner and yet the friction against rotation is minimized by the pointed pin 34 engagement with the conical depression 36.

Figure 13:
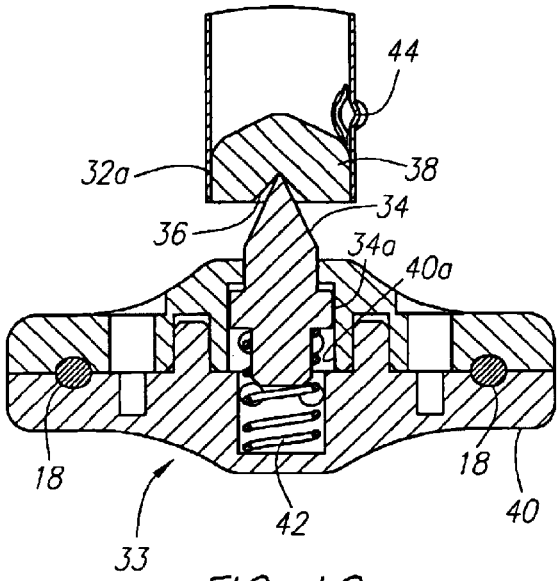
FIG. 13 is an enlarged sectional view of the front support arrangement for the spray tube taken at the circle 13 shown in FIG. 12.
Figure 14:
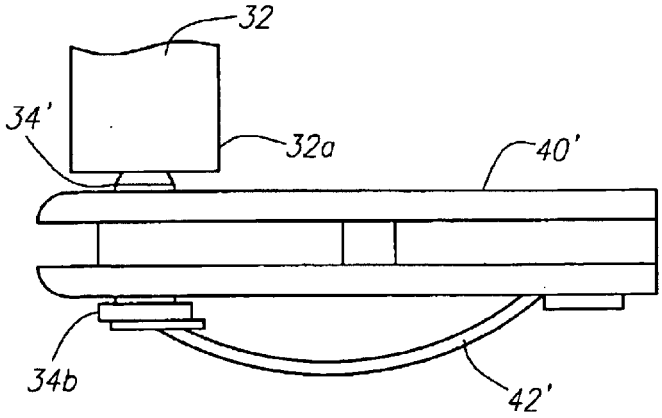
FIG. 14 is a plan view of an alternate form of front support arrangement for the water spray tube.

An alternate embodiment of the rotational support mechanism 33 for the end 32*a* of the spray tube 32 is shown in FIG. 14. In this embodiment a pointed pin 34' is slidably mounted in a through hole in a bracket 40' and an end flange 34*b* of the pin 34' is engaged by a leaf spring 42' which has its other end secured to the bracket 40' for resiliently urging the pin 34' toward the tube 32. The pointed end of the pin 34' engages the same or a similar conical depression in a plug 38 in the end 32*a* of the spray tube 32, as shown in FIG. 13. It is to be understood and will readily appear to those skilled in the art that any form of mounting arrangement can be used to rotatably support the end 32*a* of the spray tube 32 in addition to the embodiments shown in FIGS. 13 and 14, such as a thrust bearing, as long as the tube 32 is rotatably supported and does not become dislodged from the elbow 30 by the water flow and pressure supplied to the spray tube 32.

Figure 15:
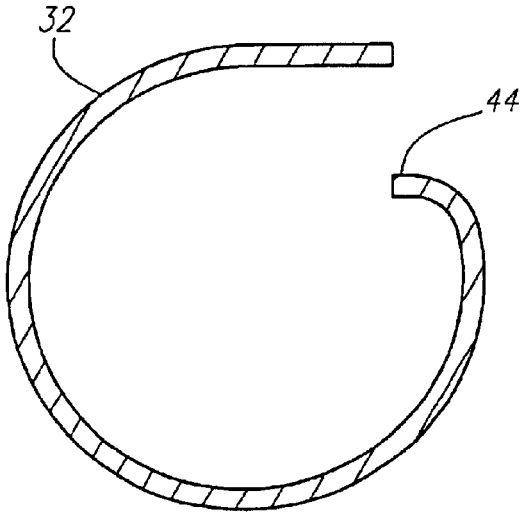
FIG. 15 is an enlarged sectional view taken on the line 15—15 in FIG. 12 for illustrating the water spray outlet from the tube.
Figure 16:
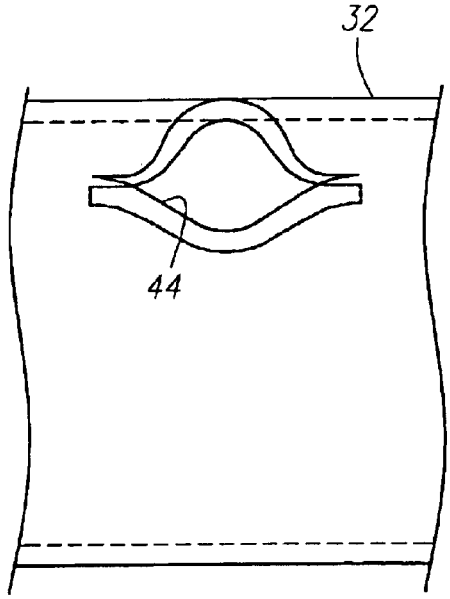
FIG. 16 is a side elevation view of a portion of the spray tube illustrating the spray outlet shown in FIG. 15.

Referring also to FIGS. 15 and 16, a plurality of water spray outlets 44 are provided along the length of spray tube 32 and preferably the water spray outlets 44 are also circumferentially offset along the length of the spray tube 32. The water spray outlet 44 shown in FIGS. 15 and 16 is conveniently and inexpensively formed by die punching a stainless steel tube so that the outlet is aimed at an angle to the radius of the tube 32 and aimed as close to tangential as possible whereby the discharging spray water causes the spray tube 32 to rotate in the opposite direction, namely, in the counter clockwise direction for the tube 32 shown in FIG. 15.

Figure 17:
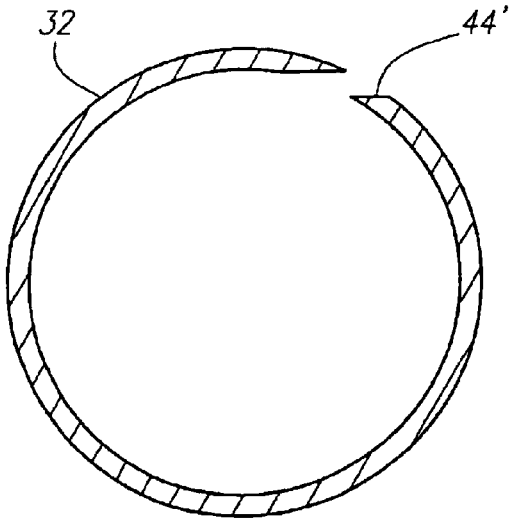
FIG. 17 is a sectional elevation view similar to FIG. 15 but illustrating an alternate embodiment of the water spray outlet from the tube.
Figure 18:
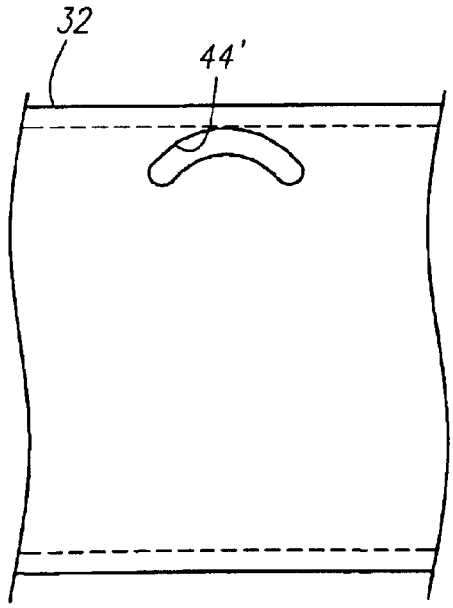
FIG. 18 is an elevation view similar to FIG. 16 but illustrating the spray outlet shown in FIG. 17.

FIGS. 17 and 18 show an alternative form of water spray outlet 44' which is arcuate in shape and formed by a machining or other process but again the outlet 44' is aimed in a nearly tangential direction or at least angled from the radius of the spray tube 32 for causing rotation of the spray tube in the opposite direction. It will readily appear to those skilled in the art that the water spray outlets in the spray tube 32 may be formed in any convenient manner either from the material of the tube 32, as shown in FIGS. 15–18, or by installing spray nozzles or the like in holes spaced along and around the tube 32 so long as the spray tube 32 is caused to rotate by the discharge of the water and a thorough spray is developed along the entire length of the tube. In this manner, as the tube 32 rotates, the water is sprayed intermittently and forcefully at all of the cups, glasses, dishes, etc. positioned at the lateral sides of the upper rack 16 as well as also spraying downwardly on the items positioned in the lower rack described hereinafter.

Referring again to FIG. 12, a flow control plug 46 is provided in the end 32*b* of spray tube 32 that is rotatably mounted in the end 30*a* of elbow 30. The flow control plug 46 is preferably provided with a conical orifice 48 of an appropriate angle and size to control the flow of water into that tube 32. The orifice 48 may differ for each spray tube 32 whereby the water flow to each of the tubes 32 as well as the centrally located spinners (described hereinafter) is properly proportioned to provide the proper spray from each spray tube 32 and each spinner based on the volume and pressure of the water supply from the conventional dishwasher recirculating pump 50 (see FIG. 2) in the bottom of the dishwasher.

Figure 2:
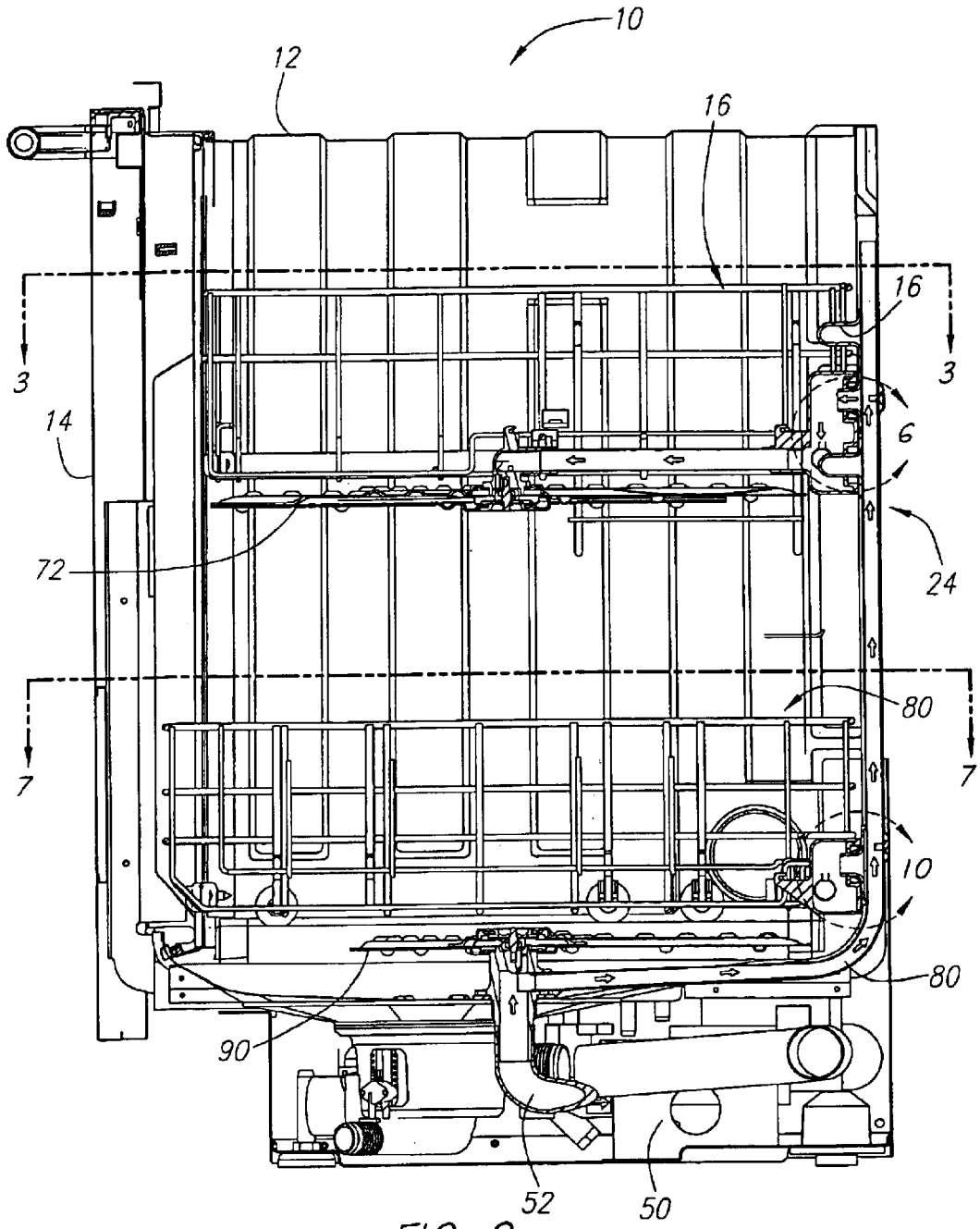
FIG. 2 is a sectional elevation view of the dishwasher of the present invention taken through the center of the dishwasher from the right side.
Figure 5:
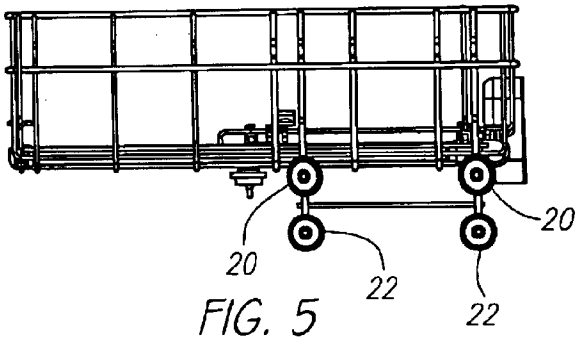
FIG. 5 is a right side elevation view of the upper dish rack shown in FIGS. 3 and 4.
Figure 4:
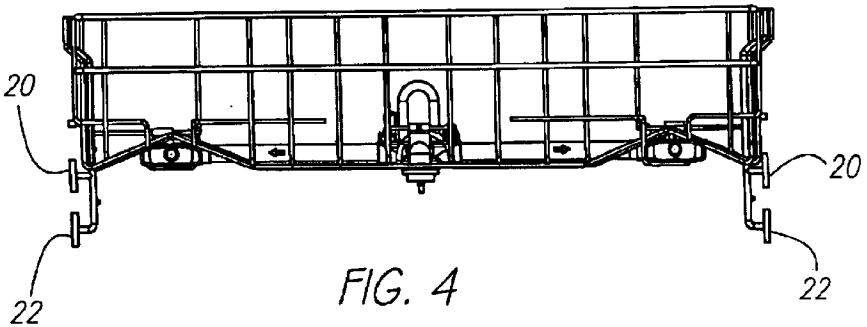
FIG. 4 is a front elevation view of the upper disk rack shown in FIG. 3.
Figure 3:
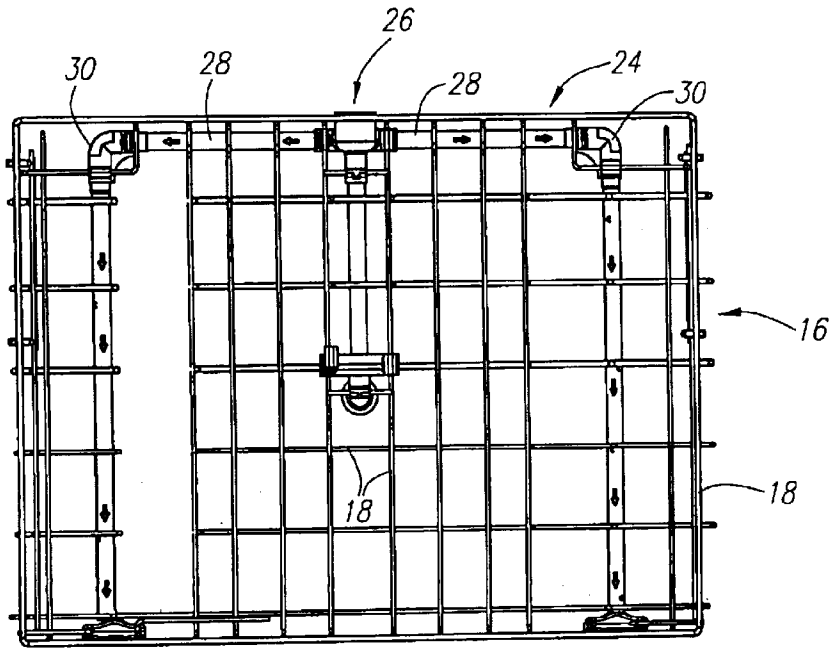
FIG. 3 is a plan view of the upper dish rack taken on the line 3—3 in FIG. 2 with the dishwasher housing and door omitted.

Referring now more particularly to FIGS. 2, 6 and 11, the outlet of the recirculating pump 50 is connected by a pipe 52 to a manifold 54 that extends from the bottom center along the bottom of the dishwasher to the back and then up the rear wall to the location of the upper rack 16. The manifold 54 preferably is of a rectangular cross-section to minimize the space required whereby the dishwashing space is maximized and yet an adequate cross-sectional area is maintained for water flow. The water connection arrangement 26 for the upper water spraying system 24 includes a housing 56 having a rear wall with two openings 58, one above the other, for fitting over projections 60 and 62 of a member attached to the manifold 54. The projection 60 is open and communicates with a hole 54*a* on the front of the manifold 54. The projection 62 is closed and a similar closed projection 64 is provided above the open projection 60 (see FIG. 2). The purpose of this three projection arrangement is so that the upper rack 16 may be moved between upper and lower positions by reason of the interengagement of the previously described rollers 20, 22 and the tracks mounted on the side walls. In the Figures, rack 16 is in the lower position but it may be seen from FIGS. 2 and 11 that by pulling the rack 16 out and reinserting same in a position a couple of inches higher that the lower hole 58 in housing 56 will become positioned over the open projection 60 and the upper hole 58 will become positioned over the upper closed projection 64. In either position the water from the manifold 54 discharges through open projection 60 into the housing 56 and then into the laterally extending conduits 28 that are attached to the housing 56, as shown by the arrows. A circular seal 66 may be provided to surround the open projection 60 and the hole 58 to minimize the leakage from housing 56. In the event a two level arrangement for upper dish rack 16 is not used, then the water connection arrangement 26 may be substantially simplified, similar to that which is used on the lower dish rack described hereinafter. Another conduit 68 extends forwardly from the housing 56 to an elbow 70 on which a spinner 72 is rotatably mounted. The conduit 68, elbow 70 and spinner 72 are supported from the wires 18 of the rack 16, such as by clips 74 in the same or a similar manner that the conduits 28, elbows 30 and housing 56 are supported from the wires 18 of the basket 16. The spinner 72 may be of a somewhat conventional design having a plurality of spray outlets 76 directed upwardly and downwardly to spray the contents of the upper and lower racks. The spinner 72 also has outlets (not visible) on the trailing edge of the spinner blades for the discharge of water therethrough to cause rotation of the spinners in a conventional manner.

Figure 10:
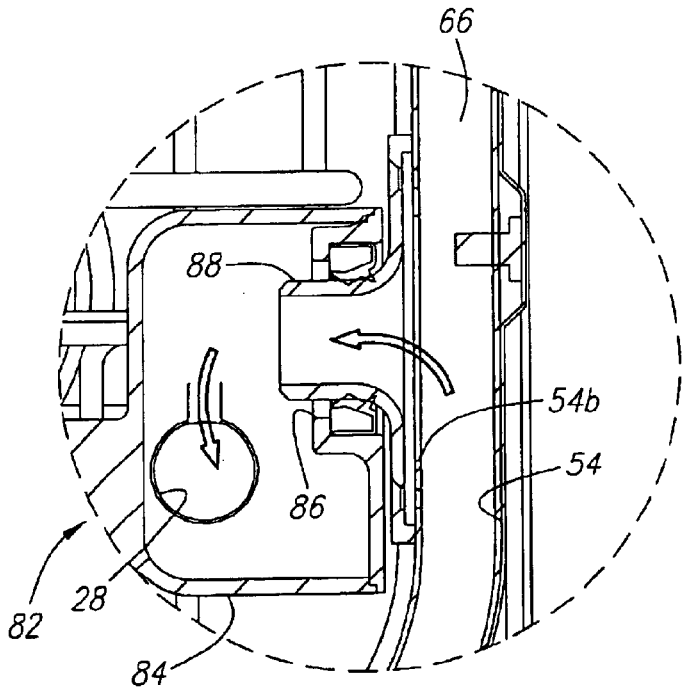
FIG. 10 is an enlarged elevation view of the water supply connection arrangement for the lower dish rack taken at the circle 10 in FIG. 2.
Figure 9:
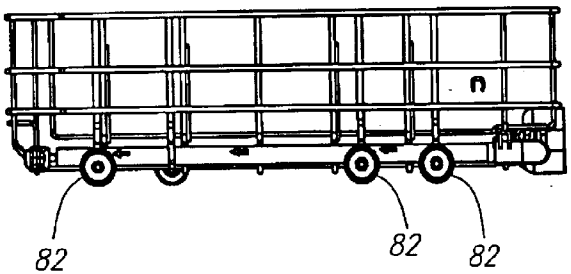
FIG. 9 is a right side elevation view of the lower dish rack shown in FIGS. 7 and 8.
Figure 8:
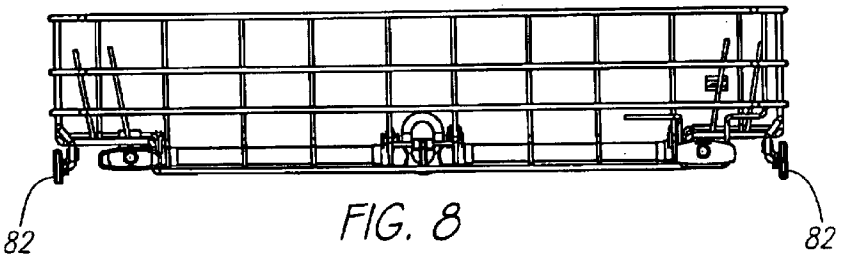
FIG. 8 is a front elevation view of the lower dish rack shown in FIG. 7.
Figure 7:
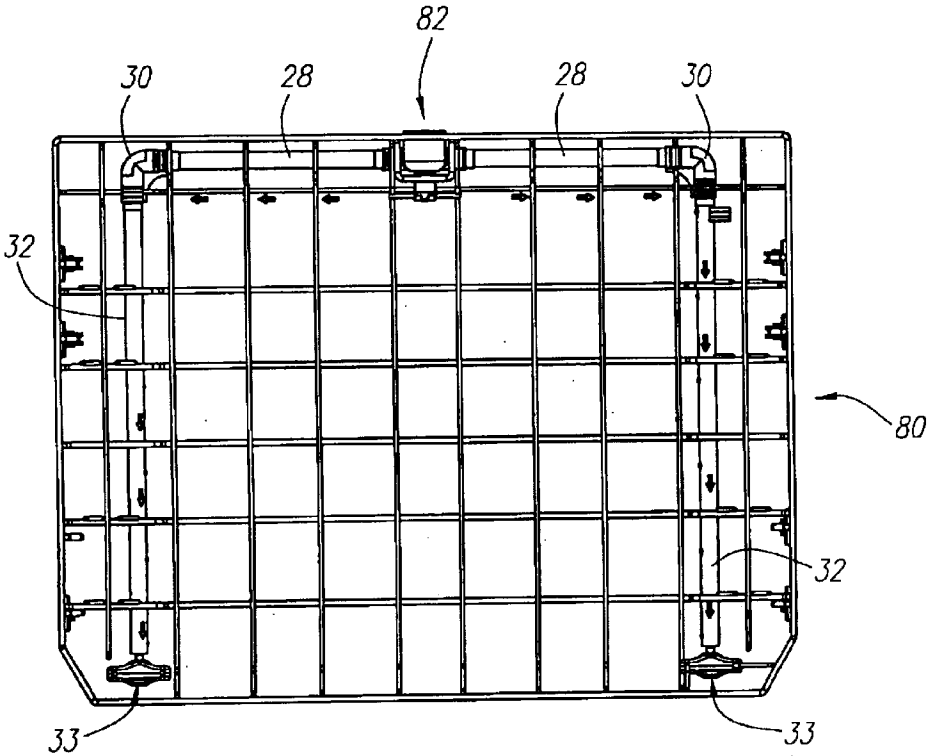
FIG. 7 is a plan view of the lower dish rack taken substantially on the line 7—7 in FIG. 2 with the dishwasher housing and front door omitted.

Referring now to FIGS. 2, 7, 8 and 9, the lower dish rack, generally designated 80, is provided with a plurality of rollers 82 for rolling along the bottom of the dishwasher and on the inside surface of the door 14 when the door is open in a manner that is conventional for domestic dishwashers. As with the upper rack 16, lower rack 80 is provided with a pair of rotatably mounted spray tubes 32 extending from elbows 30 at the rear to support mechanisms 33 at the front immediately below the wires of lower dish rack 80. Laterally extending conduits 28 connect the elbows 30 to a water connection arrangement 82 that is similar to water connection arrangement 26 for the upper rack 16 but is simplified by reason of not accommodating the rack at two separate levels and not having a spinner attached to the rack 80 as described above with respect to the upper rack 16. Specifically, as shown in FIG. 10, the water connection arrangement 82 for the lower rack 80 includes a housing 84 with only one hole 86 in the back wall for receiving an open projection 88 of a member mounted on the manifold 54 over a hole 54*b* in the front surface of the manifold 54. Again, a circular seal 66 may be provided between the hole 86 and the projection 88. The water from the manifold 54 enters the housing 84 through the open projection 88 and then passes outwardly through the pair of conduits 28, as shown by the arrows in FIG. 10. The supply of water passes through the conduits 28 to the spray tubes 32 where the discharge of the water causes the tubes 32 to rotate and spray water upwardly into the lateral sides of the lower basket 80. A spinner 90 is rotatably mounted in the center of the bottom of the dishwasher and communicates directly with the pipe 52 from the recirculating pump 50. Like spinner 72, spinner 90 has spray outlets 92 for spraying upwardly into the items in the lower rack 80 and further outlets (not shown) in the trailing edge of the blades to cause rotation of the spinner 90.

With this dishwasher arrangement of FIGS. 1–18 as described above, it may be seen that the upper and lower dish racks 16, 80 are sprayed by wash and rinse water in the conventional manner by spinners 72, 90 but also the lateral sides of the upper and lower racks 16, 80 are sprayed by the rotating spray tubes 32 supported below the lateral sides of each rack. In this manner, there is a complete water spray coverage of the racks, including the lateral sides and the four vertical corners of the dishwasher 10 that are not easily reached by the spray from the conventional centrally located spraying spinners. Moreover, for a dishwasher 10 of a width W substantially larger than the depth D, whereby the centrally located spinners 72 and 90 do not reach the lateral sides because their diameter is limited by the internal depth of the dishwasher, the rotating spray tubes 32 along the longitudinal sides of the upper and lower racks 16, 80 provide the water spray coverage necessary to thoroughly wash and rinse the dishes, glasses, cups, pans, oversized utensils, etc. that are positioned in the lateral sides of the dishwasher racks 16 and 80. By this arrangement the lateral width W of a dishwasher and therefore the dishwasher capacity is not limited by the depth of the cabinets and in turn the depth D of the dishwasher.

Figure 19:
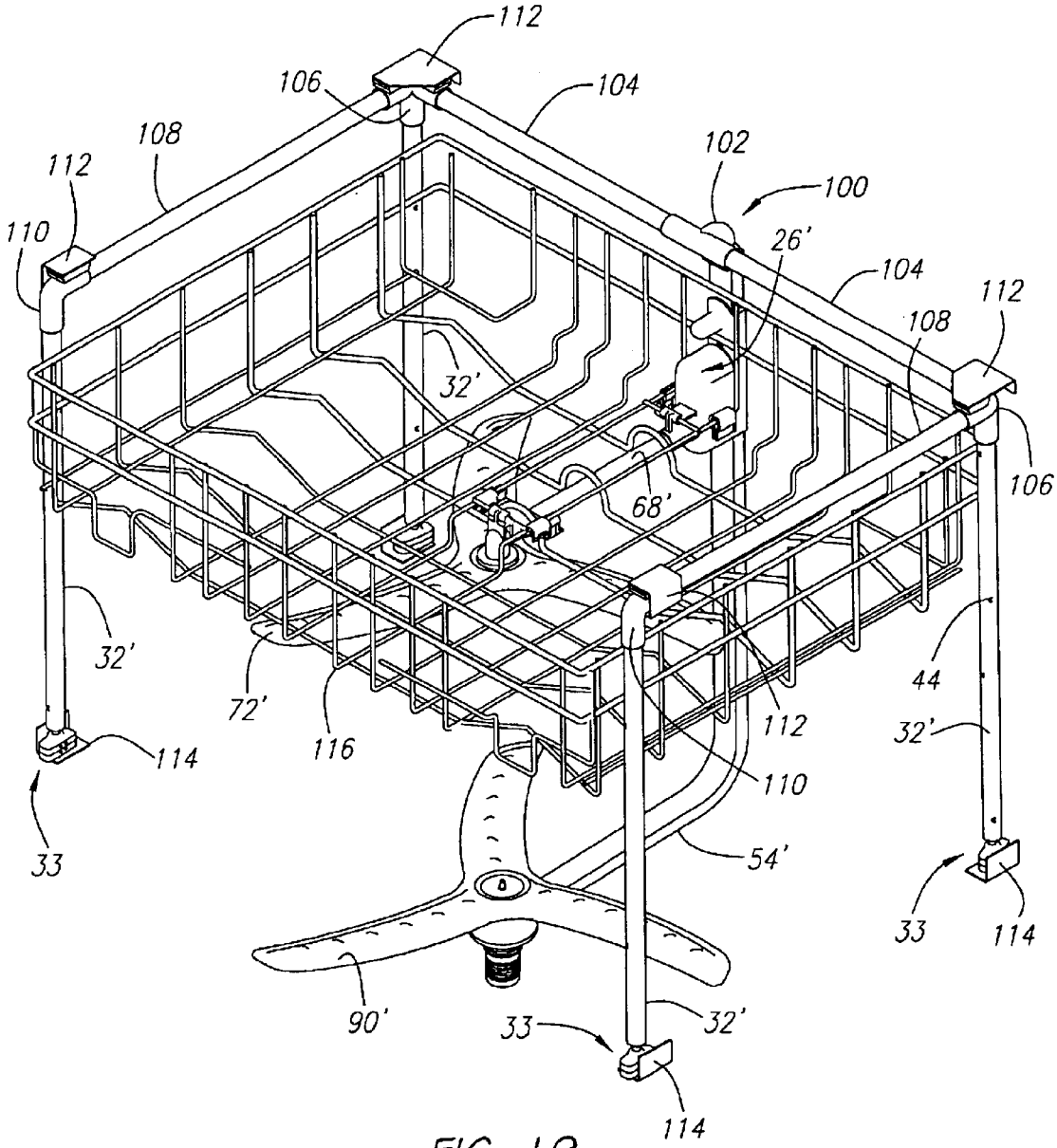
FIG. 19 is a perspective view similar to FIG. 11 but illustrating another embodiment of the water spraying system of the present invention and including the upper dish rack.
Figure 20:
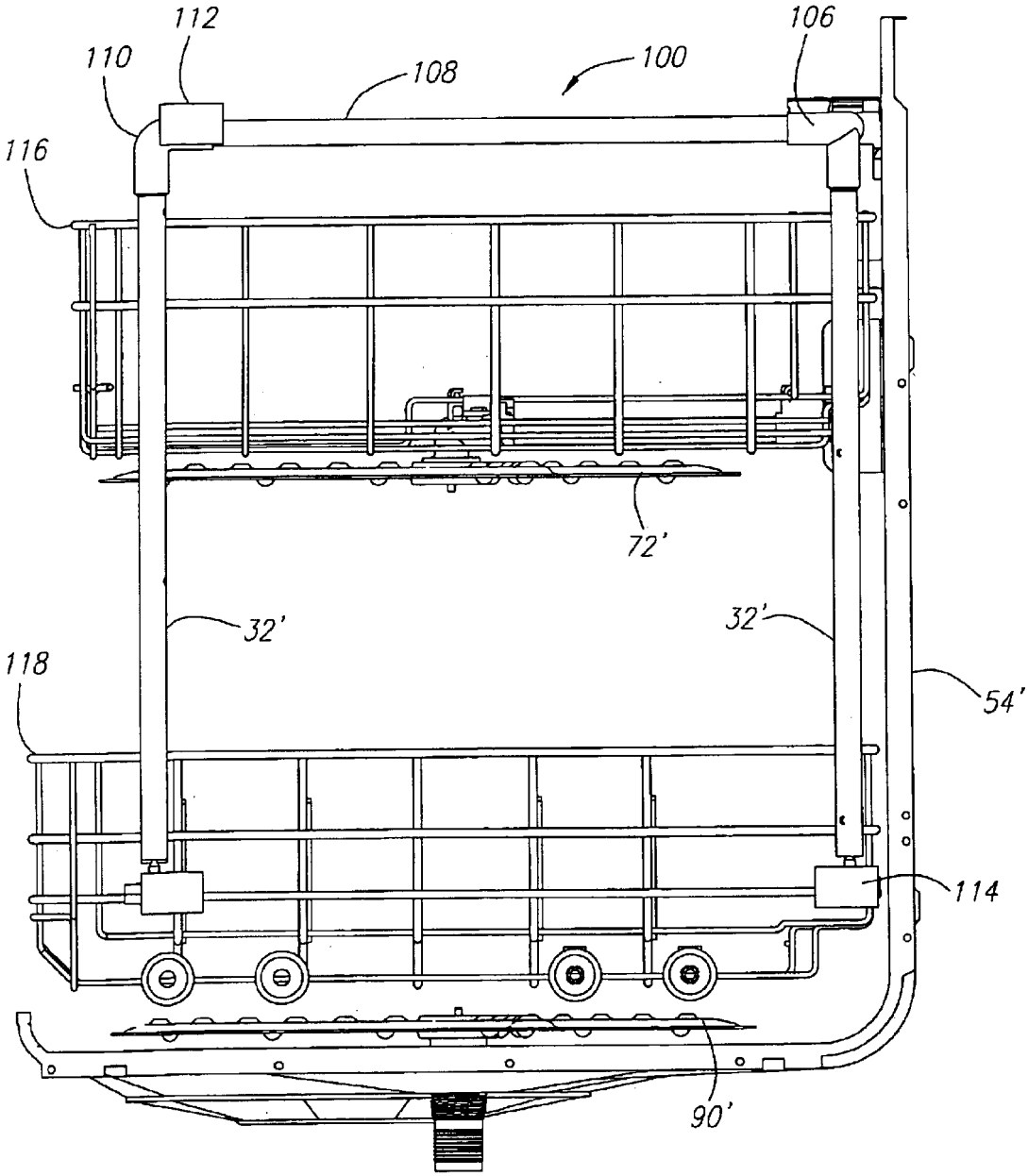
FIG. 20 is a side elevation view of the water spraying system embodiment of FIG. 19 with the upper and lower dish racks in position.

Referring now to FIGS. 19 and 20, another embodiment of the present invention is illustrated wherein the rotating spray tubes extend vertically and are not mounted on the upper and lower dish racks. Specifically, the manifold 54' again extends from the recirculation pump (not shown) rearwardly along the bottom of the dishwasher and then up the back wall to supply wash and rinse water to a water spray system 100. A fitting 102 is fixedly connected to the manifold 54' and conduits 104 extend laterally in opposite directions from the fitting 102 to three-way elbows 106 in opposite lateral corners at the rear of the dishwasher. A conduit 108 extends forwardly from each three-way elbow 106 to a front elbow 110. As thus far described, the fitting 102, the conduits 104, 108 and the elbows 106, 110 are fixedly connected to each other and are connected by brackets 112 to the inside walls or ceiling of the dishwasher cabinet (not shown). A spray tube 32' is rotatably mounted on the downwardly extending portion of each of the elbows 106, 110 in the four corners of the dishwasher. The lower end of each spray tube 32' is rotatably supported by any convenient means such as the previously described support mechanisms 33 shown in detail in FIGS. 12–14. Each support mechanism 33 is mounted by a bracket 114 to the interior wall or bottom of the dishwasher. Each of the spray tubes 32' is provided with a plurality of circumferentially and vertically spaced water spray outlets 44 or 44', as shown in FIGS. 15–18, whereby the supply of wash and rinse water from the recirculation pump causes each of the tubes 32' to rotate on a vertical axis in each corner of the dishwasher and thoroughly spray all of the items in the corners and along the lateral sides of the upper and lower dish racks 116, 118. The roller and track supports (not shown) for racks 116, 118 are mounted inwardly of the spray tubes 32' to permit the fore and aft movement of the racks. In addition, upper and lower spinners 72', 90' are provided that are similar to or the same as spinners 72, 90 shown and described with respect to the first embodiment. Again, the upper rack 116 may be of the type that is supportable at two levels and therefore a water connection arrangement 26' the same as or similar to water connection arrangement 26 of the first embodiment will be provided for releasable connection to the manifold 54'. Again a conduit 68' extends forwardly from the water connection arrangement 26' to supply water to the upper spinner 72'.

Figure 21:
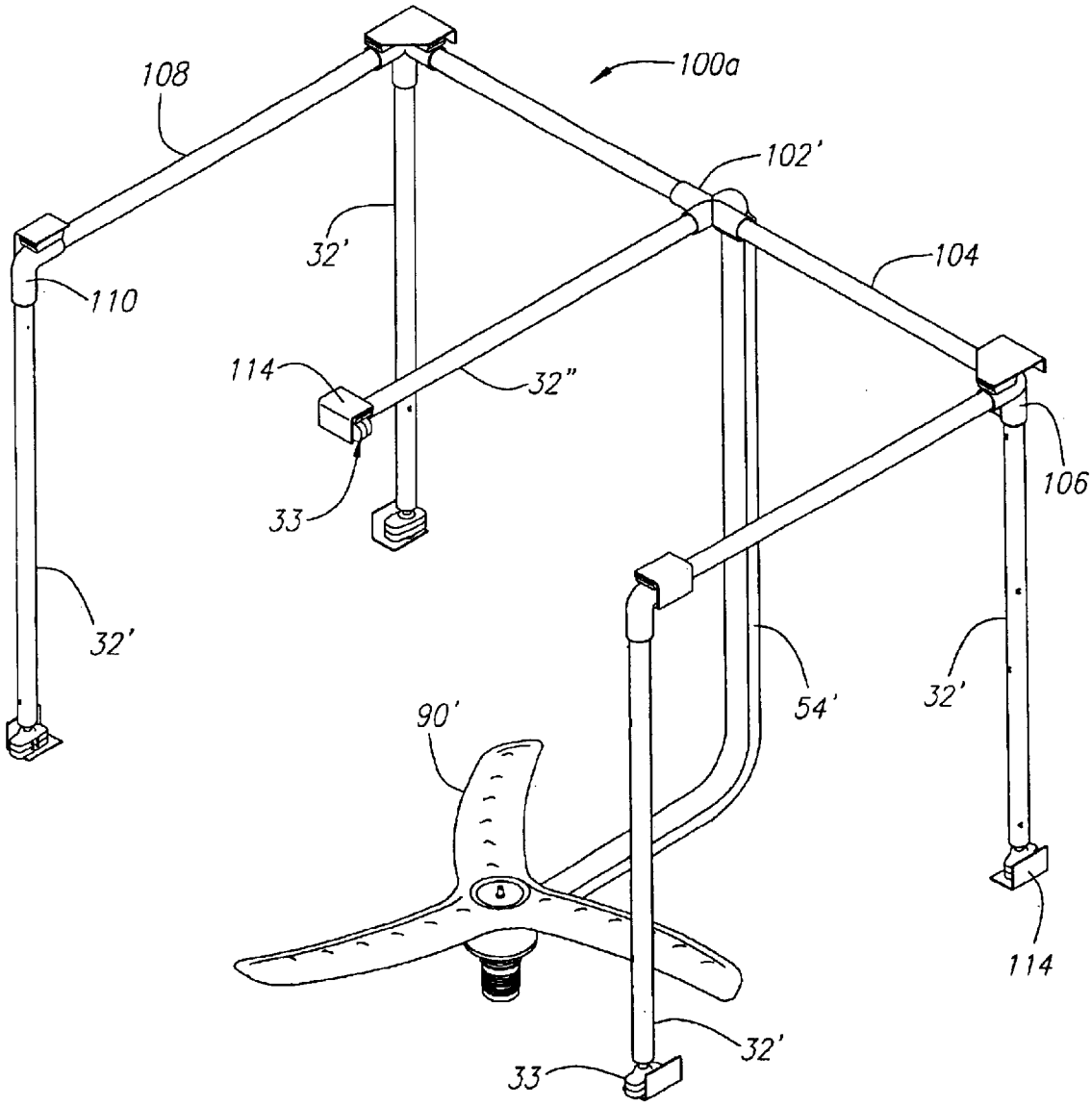
FIG. 21 is a perspective view similar to FIG. 19 but illustrating a modified form of the water spray system.

Referring now to FIG. 21, a water spraying system 100*a* is shown that is a modified embodiment of the water spray system 100 shown in FIGS. 19 and 20. In this modified embodiment the only difference is that the upper spinner 72' and the components for supplying water thereto are eliminated and replaced by a water spray tube 32" extending forwardly from and rotatably mounted in a fitting 102' along the ceiling of the dishwasher. Again, the front end of the spray tube 32" is rotatably supported by a support mechanism 33 mounted on the ceiling by a bracket 114. The remaining components are the same as the embodiment of FIGS. 19 and 20 and their description will not be repeated.

Figure 22:
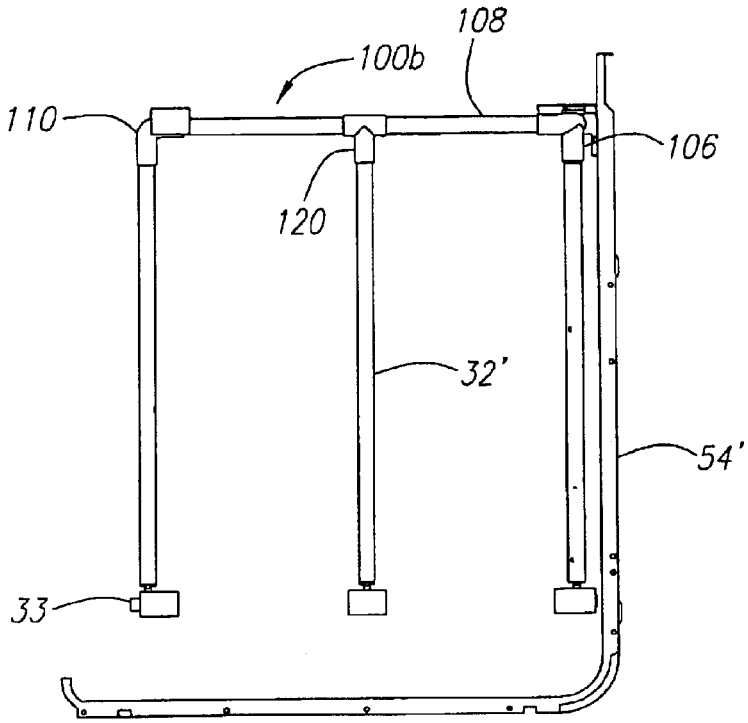
FIGS. 22 and 23 are side elevation views of still further modified forms of the spray water systems of the present invention similar to the systems of FIGS. 19–21.
Figure 23:
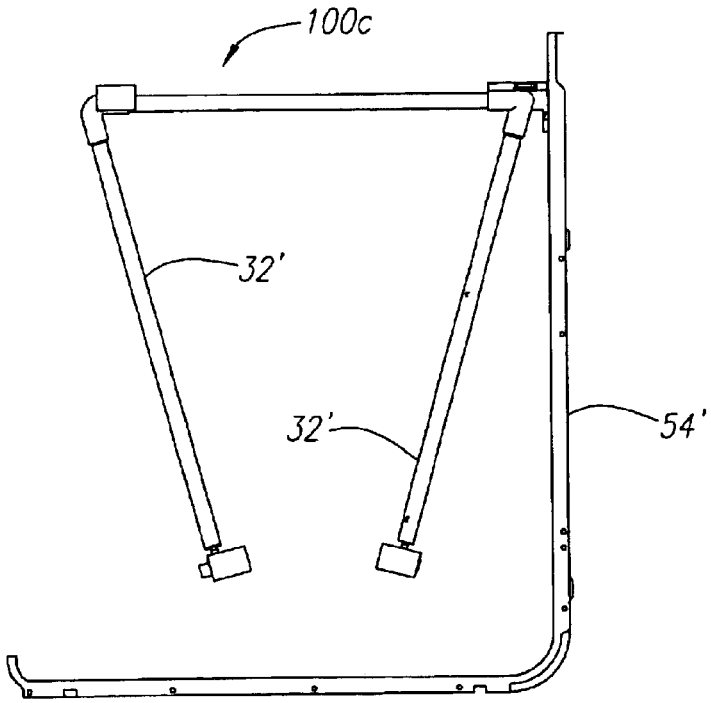

Referring now to FIGS. 22 and 23, two additional modified forms of the embodiments of this invention shown in FIGS. 19–21 are shown. In the embodiment of the water spraying system 100*b* shown in FIG. 22, an additional rotating water spray tube 32' is rotatably mounted on a tee fitting 120 in conduit 108 at approximately the mid point between the front and back of the dishwasher to provide additional water spray coverage but in all other respects the water spraying system 100*b* may be the same as system 100 or 100*a*. The further modified form of the water spray system 100*c* that is shown in FIG. 23 has the rotating water spray tubes 32' mounted on an angle relative to the vertical to provide still a different water spray pattern. Thus, it will readily appear to those skilled in the art from FIGS. 19–23 that the generally vertically oriented rotating spray tubes 32' may be located and positioned wherever it is most convenient and effective for the dishwasher.

Although a number of embodiments and modifications of the water spraying systems of the present invention have been specifically shown and described, it will readily appear to those skilled in the art that the present invention is not limited thereto but that still further embodiments and modifications may be made without departing from the scope of the present invention as defined by the appended claims.

What is claimed:

1. A water spray system for a dishwasher having lateral sides, comprising:

at least one elongated spray tube rotatably mounted adjacent each lateral side of the dish washer to rotate on the axis of the tube, a conduit device rotatably connected to each said spray tube for supplying water to said spray tube, and each said tube having a plurality of spray outlets along said tube, said spray outlets directed angularly relative to the tube radius for water discharged through said spray outlets to cause rotation of said tube on said tube axis.

2. The water spray system of claim 1, wherein said spray tubes extend horizontally from front to back of the dishwasher.

3. The water spray system of claim 2, wherein said spray tubes are rotatably mounted on a dish rack in the dishwasher.

4. The water spray system of claim 3, wherein said spray tubes are rotatably mounted on the bottom of the dish rack.

5. The water spray system of claim 3, wherein a releasable water connection is provided at the rear of said dish rack for releasably connecting said conduit device to a water supply to allow said dish rack to move forwardly in the dishwasher.

6. The water spray system of claim 5, wherein said dish rack is supported in an upper portion of the dishwasher at two levels, and said releasable water connection accommodates either level for supplying water to said spray tubes.

7. The water spray system of claim 5, wherein said dish rack is supported in an upper portion of the dishwasher and a water spray spinner is mounted at the center of said dish rack to rotate about a vertical axis and spray water, and a conduit is provided and connects said spray spinner to said releasable water connection.

8. The water spray system of claim 7, wherein said spray spinner is mounted on the bottom of said rack.

9. The water spray system of claim 2, wherein a pair of said spray tubes are rotatably mounted on an upper dish rack and another pair of said spray tubes are rotatably mounted on a lower dish rack.

10. The water spray system of claim 9, wherein said spray tubes are rotatably mounted on the bottom of each said rack.

11. The water spray system of claim 9, wherein a releasable water connection is provided at the rear of each said dish rack for releasably connecting said conduit device to a water supply to allow said dish rack to move forwardly in the dishwasher.

12. A water spray system for a dishwasher having lateral sides, comprising:

at least one spray tube rotatably mounted adjacent each lateral side of the dishwasher to rotate on the axis of the tube, a conduit device rotatably connected to each said spray tube for supplying water to said spray tube, and each said tube having a plurality of spray outlets along said tube, said spray outlets directed angularly relative to the tube radius for water discharged through said spray outlets to cause rotation of said tube;

wherein said spray tubes extend in a vertical direction, each said spray tube being rotatably mounted on the inside of a cabinet of the dishwasher.

13. The water spray system of claim 12, wherein a said spray tube is rotatably mounted in each the four corners of the cabinet.

14. The water spray system of claim 13, wherein another said spray tube extends vertically and is rotatably mounted adjacent each lateral side at a location midway along the lateral side.

15. The water spray system of claim 12, wherein another spray tube extends horizontally from front to back along a ceiling of the dishwasher cabinet.

16. The water spray system of claim 1, wherein a pair of said spray tubes are rotatably mounted adjacent each lateral side of the dishwasher and extend at an acute angle to vertical.

17. A water spray system for a dishwasher having lateral sides, comprising:

at least one spray tube rotatably mounted adjacent each lateral side of the dishwasher to rotate on the axis of the tube, a conduit device rotatably connected to each said spray tube for supplying water to said spray tube, and each said tube having a plurality of spray outlets along said tube, said spray outlets directed angularly relative to the tube radius for water discharged through said spray outlets to cause rotation of said tube;

wherein said rotatable mounting of each spray tube includes a pointed pin engaging a conical depression in one end of and on the axis of said spray tube.

18. The water spray system of claim 17, wherein a spring engages said pointed pin and resiliently urges the pointed pin into said conical depression.

19. The water spray system of claim 17, wherein the other end of each said spray tube is cylindrical and fits into a cylindrical opening in said conduit device for said rotatable connection therebetween.

20. The water spray system of claim 1, wherein said plurality of spray outlets are spaced both longitudinally and circumferentially along each said spray tube.

21. The water spray system of claim 1, wherein said plurality of spray outlets are formed of the material of each said spray tube.

22. The water spray system of claim 21, wherein said material is stainless steel tubing and said plurality of spray outlets are formed by die punching the stainless steel tubing.

23. The water spray system of claim 1, wherein each said spray tube is provided with an orifice at an inlet to each said spray tube for controlling the water flow to each said spray tube.

24. A water spray system for a dishwasher having lateral sides, comprising:

at least one spray tube rotatably mounted adjacent each lateral side of the dishwasher to rotate on the axis of the tube, a conduit device rotatably connected to each said spray tube for supplying water to said spray tube, and each said tube having a plurality of spray outlets along said tube, said spray outlets directed angularly relative to the tube radius for water discharged through said spray outlets to cause rotation of said tube;

wherein each said spray tube is provided with an orifice at an inlet to each said spray tube for controlling the water flow to each said spray tube; and wherein the size of said orifice for each said spray tube is selected to provide an optimum water flow to all said spray tubes.

25. A water spray system for a dishwasher with an open front closable by a door, a rear wall, a ceiling, a bottom wall, side walls and a pump below the bottom wall for circulating wash and rinse water, comprising:

an upper dish rack and a lower dish rack, each said dish rack being mounted for selective movement forwardly out the open front and rearwardly toward the rear wall, each said dish rack having lateral side portions adjacent the side walls and a rear portion;

a manifold extending from the pump upwardly along the rear wall;

a conduit mounted on and extending laterally along said rear portion of each said dish rack;

a releasable water connection device between each said conduit and said manifold for supplying the water to said conduits from the pump when each said dish rack is moved rearwardly to the rear wall; and an elongated spray tube rotatably mounted on each said lateral side portion of each said dish rack for rotation on the axis of said spray tube, each said spray tube being rotatably connected to said conduit on that said dish rack for receiving the water, and each said spray tube having a plurality of outlets spaced along said spray tube and directed generally tangentially in the same circumferential direction for causing rotation of said spray tube.

26. The water spray system of claim 25, wherein said upper dish rack is selectively supported at two levels, and said releasable water connection accommodates either level for supplying water to said spray tubes.

27. The water spray system of claim 26, wherein a water spray spinner is mounted at the center of said upper dish rack to rotate about a vertical axis and spray water, and another conduit connects said spray spinner and said releasable water connection.

28. The water spray system of claim 25, wherein a water spray spinner is mounted at the center of said upper dish rack to rotate about a vertical axis and spray water, and another conduit connects said spray spinner and said releasable water connection.

29. The water spray system of claim 28, wherein said spray spinner is mounted on the bottom of said upper rack.

30. A water spray system for a dishwasher with an open front closable by a door, a rear wall, a ceiling, a bottom wall, side walls and a pump below the bottom wall for circulating wash and rinse water, comprising:

an upper dish rack and a lower dish rack, each said dish rack being mounted for selective movement forwardly out the open front and rearwardly toward the rear wall, each said dish rack having lateral side portions adjacent the side walls and rear portion;

a manifold extending from the pump upwardly along the rear wall;

a conduit mounted on and extending laterally along said rear portion of each said dish rack;

a releasable water connection device between each said conduit and said manifold for supplying the water to said conduits from the pump when each said dish rack is moved rearwardly to the rear wall;

a spray tube rotatably mounted on each said lateral side portion of each said dish rack and rotatably connected to said conduit on that said dish rack for receiving the water, each said spray tube having a plurality of outlets spaced along said spray tube and directed generally tangentially in the same circumferential direction for causing rotation of said spray tube;

wherein said rotatable mounting of each spray tube includes a pointed pin engaging a conical depression on one end of and on the axle of said spray tube.

31. The water spray system at claim 30, wherein a spring engages said pointed pin and resiliently urges the pointed pin into said conical depression.

32. The water spray system of claim 30, wherein the other end of each said spray tube is cylindrical and fits into a cylindrical opening in an elbow connected to said conduit for said rotatable connection therebetween.

33. The water spray system of claim 25, wherein said plurality of spray outlets are spaced both longitudinally and circumferentially along each said spray tube.

34. The water spray system of claim 25, wherein each said spray tube is provided with an orifice at an inlet to each said spray tube for controlling the water flow to said spray tube.

35. A water spray system for a dishwasher with an open front closable by a door, a rear wall, a ceiling, a bottom wall, side walls and a pump below the bottom wall far circulating wash and rinse water, comprising:

an upper dish rack and a lower dish rack, each said dish rack being mounted for selective movement forwardly out the open front and rearwardly toward the rear wall, each said dish rack having lateral side portions adjacent the side walls and a rear portion;

a manifold extending from the pump upwardly along the rear wall;

a conduit mounted on and extending laterally along said rear portion of each said dish rack;

a releasable water connection device between each said conduit and said manifold for supplying the water to said conduits from the pump when each said dish rack is moved rearwardly to the rear wall;

a spray tube rotatably mounted on each said lateral side portion of each said dish rack and rotatably connected to said conduit on that said dish rack for receiving the water, each said spray tube having a plurality of outlets spaced along said spray tube and directed generally tangentially in the same circumferential direction for causing rotation of said spray tube;

wherein each said spray tube is provided with an orifice at an inlet to each said spray tube for controlling the water flow to each said spray tube; and wherein the size of said orifice for each said spray tube is selected to provide an optimum water flow to all said spray tubes.

36. A water spray system for a dishwasher having a greater width than depth with an open front closable by a door, a rear wall, a ceiling, a bottom wall, side walls and a pump for circulating wash and rinse water, comprising:

an upper dish rack and a lower dish rack, each said dish rack being mounted for selective movement forwardly out the open front and rearwardly toward the rear wall, each said dish rack having lateral side portions adjacent the side walls and a rear portion;

a manifold extending from the pump upwardly along the rear wall;

a conduit mounted on and extending laterally along said rear portion of each said dish rack;

a releasable water connection device mounted on the rear portion of each said rack between each said conduit and said manifold for supplying the water to said conduits from the pump when each said dish rack is moved rearwardly to the rear wall;

an upper spinner centrally mounted on the bottom of said upper dish rack and operatively connected to said releasable water connection device on said upper rack, a lower spinner centrally mounted below said lower dish rack and operatively connected to said pump;

said spinners rotatable on a vertical axis and having spray openings for discharging the water and rotating said spinners;

an elongated spray tube rotatably mounted on each said lateral side portion of each said dish rack to extend front to back for rotation on the axis of said spray tube, each said spray tube being rotatably connected to said conduit on that said dish rack for receiving the water, each said spray tube having a plurality of outlets spaced along said spray tube and directed generally tangentially in the same direction for causing rotation of said spray tube on the axis of said spray tube, and said plurality of outlets being spaced longitudinally and circumferentially; and an orifice device at an inlet of each said spray tube for controlling the water flow to each said spray tube.

* * * * *

UNITED STATES PATENT AND TRADEMARK OFFICE

CERTIFICATE OF CORRECTION

PATENT NO. : 6,869,029 B2
DATED : March 22, 2005
INVENTOR(S) : Ochoa, Sr. et al.

It is certified that error appears in the above-identified patent and that said Letters Patent is hereby corrected as shown below:

Column 10,
Line 19, delete "axle" and insert -- axis -- therefor.
Line 35, delete "far" and insert -- for -- therefor.

Signed and Sealed this

Twenty-fourth Day of May, 2005

JON W. DUDAS
*Director of the United States Patent and Trademark Office*